US005326664A

United States Patent [19]

Takagami et al.

[11] Patent Number: 5,326,664

[45] Date of Patent: Jul. 5, 1994

[54] METHOD FOR MAKING ELECTROPHOTOGRAPHIC LITHOGRAPHIC PRINTING PLATE BY REVERSAL DEVELOPMENT

[75] Inventors: Yuji Takagami; Sadao Kuriu; Koshiro Ikegami, all of Tsukuba, Japan

[73] Assignee: Mitsubishi Paper Mills Limited, Tokyo, Japan

[21] Appl. No.: 779,085

[22] Filed: Oct. 18, 1991

[30] Foreign Application Priority Data

Oct. 19, 1990 [JP] Japan ..... 2-282192

[51] Int. Cl.[5] ..... G03G 13/26

[52] U.S. Cl. ..... 430/49; 430/100

[58] Field of Search ..... 430/49, 54, 204, 205, 430/360, 301, 302, 100

[56] References Cited

U.S. PATENT DOCUMENTS 4,435,491 3/1984 Kitamura et al. ..... 430/49
4,636,452 1/1987 Furukawa et al. ..... 430/112
4,748,099 5/1988 Simada et al. ..... 430/49
5,055,370 10/1991 Suzuki et al. ..... 430/114
5,085,966 2/1992 Suzuki et al. ..... 430/115

*Primary Examiner*—Marion E. McCamish
*Assistant Examiner*—Rosemary Ashton
*Attorney, Agent, or Firm*—Cushman, Darby & Cushman

[57] ABSTRACT

The present invention provides a method for making an electrophotographic printing plate by reversal development which comprises uniformly charging the surface of an organic photoreceptor comprising an electrically conductive support and, provided thereon, an organic photoconductive compound bound with a resin binder, exposing the surface to a light image to form a static latent image corresponding to the light image on the surface of the organic photoreceptor and then, subjecting the static latent image to reversal development with an electrophotographic liquid developer containing charged toner particles, characterized in that the reversal development is carried out with the electrophotographic liquid developer having an electrodeposition potential set within the range of 0–80 V in absolute value.

7 Claims, 1 Drawing Sheet

METHOD FOR MAKING ELECTROPHOTOGRAPHIC LITHOGRAPHIC PRINTING PLATE BY REVERSAL DEVELOPMENT

BACKGROUND OF THE INVENTION

The present invention relates to a method for making an electrophotographic lithographic printing plate by reversal development, according to which a printing plate can be obtained by directly writing an image information output from electronic editing system and the like on an organic photoreceptor and carrying out reversal development.

Many methods have been known for making lithographic printing plates. For example, an original prepared by silver salt photography is allowed to contact with a light-sensitive material for printing plate and the light-sensitive layer of the material is directly exposed to ultraviolet rays thereby to form a hardened area corresponding to the image of the original and an unhardened portion corresponding to non-image. The unhardened portion is washed off with alkalis or water and the hardened portion is used as ink-receptive area. The printing plate made by this method is so-called PS plate and is widely used.

Recently, with progress of computer image processing techniques, and techniques for development of memory of high capacity data and data transmission techniques, electronic editing systems in which input, correction, editing, layout and composing of originals are all performed by computer controlling and the original can be immediately output to terminal plotters in a remote place by high speed communication networks or satelite communication have been put to practical use. Especially, in the fields of newspaper printing, not only the electronic editing systems, but also plate making systems by which printing plates can be directly obtained by the data coming from the electronic editing systems are being put to practical use. At present, in such plate making systems, those which carry out exposure to laser beam sources (such as semiconductor laser, He-Ne laser, etc.) utilizing electrophotographic process are expected from various aspects.

Furthermore, in such systems, electrophotographic lithographic printing plates of washing-off type mentioned below can be used for printing under the same printing conditions as for the conventionally employed PS plates and hence, the systems can be advantageously used. The main plate making steps are as follows: Electrophotographic material for printing plate is charged, exposed and developed to form images with toners and the non-image portion on which toners are not deposited is removed by dissolution solution to expose the surface of the support which has been previously subjected to hydrophilization treatment. Since the image portion protected with toners is oleophilic, offset printing can be performed.

An electrophotographic lithographic printing plate is made from an electrophotographic photoreceptor comprising an electrically conductive support such as aluminum and a photoconductor layer containing a photoconductive substance provided on the support. As materials which constitute the photoconductor layer of this electrophotographic photoreceptor, organic photoconductive compounds•binder resin systems as described in the following patent publications are excellent in practical sensitivity and printing endurance.

Japanese Patent Kokoku Nos. 37-17162, 38-7758 and 46-39405 and Japanese Patent Kokai Nos. 52-2437, 57-161863, 58-2854, 58-28760, 58-118658, 59-12452, 59-49555, 62-217256, 63-226668 and 1-261659.

In the steps of making electrophotographic lithographic printing plates, the photoconductive layer is first subjected to a desired charging to apply uniform charge thereto and then a static latent image corresponding to the image is formed by exposing. This static latent image is developed with an electrophotographic developer and is fixed to produce a toner image corresponding to the static latent image. The non-image area other than the toner image is dissolved and removed (decoated) with a solution containing an alkali agent or the like and successively, the surface of the plate is subjected to treatment for adjustment of apparent pH with water or an acidic rinsing solution and, if necessary, coated with a surface protective solution (protective gum solution) to obtain a final printing plate.

If in the above developing step the toner image is to be obtained by so-called reversal development, good image free from fog and thinning in lines can be obtained owing to the development characteristics. Recently, image reproducibility with high resolution and high quality is demanded and the method for making electrophotographic lithographic printing plates by reversal development meets the demand for quality.

In carrying out the reversal development, first the portion to which toners are to adhere (line image portion) is irradiated with light and the potential of the light irradiated portion is decayed to nearly zero V in the exposing step. In this case, the portion which is not irradiated with light (the portion corresponding to non-image portion) retains the initial charge potential as it is. A given developing bias is applied in the developing step region through electrodes and a given developing electric field is formed by this developing bias. On the other hand, toner particles in the developer have a charge of the same polarity as in the photoreceptor side charged by a given method. Under such state, when the photoreceptor having the static latent image enters into the developing electric field of the developing step region, the toner particles in the developer are migrated to the photoreceptor side by the developing electric field and the toner particles deposit on the portion of 0 V in potential of the photoreceptor which is the portion irradiated with light. In this case, the non-image portion in which the initial potential remains repels the toner particles and toner particles do not deposit on this portion.

Either of a dry developer or a liquid developer can be employed as the developer used for such reversal development, but in the case of the liquid developer, toner particles can be made fine and hence, good image reproducibility with high resolution can be obtained.

The liquid developer is prepared by dispersing pigment (dye) or polymer particles in a highly insulating medium to carry out coloration and adding a charge control agent thereto to impart a desired charge.

Amount of the deposited toner in the developing step, namely, image density is determined depending on the various image forming conditions and the charge quantity of the toner particles mentioned above is an extremely important condition for determination of image qualities such as image density. That is, as aforementioned, in the reversal development, a portion of 0 in potential is formed by partial exposure of the initially uniformly charged area of photoreceptor side and this portion of 0 in potential is filled with the charge of the toner particles and thus the toner particles are allowed to adhere to or deposit on this portion. Therefore, amount of the deposited toner particles varies depending on charge quantity possessed by individual particle and in general, with increase in charge quantity of individual toner particles, amount of the deposited toner particles decreases and image density reduces and with decrease in charge quantity of the individual toner particle, amount of the deposited toner particles increases and image density enhances.

On the other hand, the charge quantity of the toner particles not only varies the image density, but also causes the following phenomena to occur.

First, consideration will be given to the case where a non-image portion in which the initial potential remains as it is, is continuously fed into a developing zone. If the developing bias potential applied from opposing electrodes is lower than the charged potential in this case, the toner particles charged in the same polarity as of the charge potential of the non-image portion are subjected to repelling power of the non-image portion and are forced back to the opposing electrode side. Therefore, when the non-image portion is continuous, the toner particles are electrically deposited and accumulated on the surface of the electrodes or localization of the toner particles gradually becomes conspicuous.

On the other hand, sometimes an additional electric field occurs from the toner particle which are electrically deposited and accumulated on the opposing electrodes or which are in densely localized state. The electric field generated from the toner particles is added to the bias voltage as an additional electric field in addition to the inherent developing bias electric field. When this additional electric field increases, a certain amount of toner particles sometimes abruptly begins to migrate to the photoreceptor side at a certain timing. This phenomenon occurs irrespective of non-image portion or image portion, resulting in deposition of the toner particles in a large amount. The inventors named this phenomenon "toner avalanching phenomenon".

If the above-mentioned toner avalanching phenomenon occurs in the developing step of electrophotographic lithographic printing plates, toner particles deposit on the non-image portion other than the desired image portion and prevent decoating of the non-image portion. When printing is carried out using the electrophotographic lithographic printing plate in which this phenomenon has occurred, reduction of resolution of prints and stain of prints are brought about. Thus, the toner avalanching phenomenon conspicuously deteriorates the quality as printing plate.

Furthermore, developing speed in development with liquid developer, namely, deposition amount of toners (image density) is determined by various conditions for image formation, but concentration of toner particles which is solid concentration in the liquid developer is a very important condition in determination of image quality based on the developing speed and image density. As aforementioned, in reversal development, a portion of nearly 0 in potential is partially formed by exposure in the initially uniformly charged area and deposition of the developer is performed by filling up the portion of nearly 0 in potential with the charge of toner particles. Therefore, developing speed (deposition amount of toners) varies depending on concentration of toner particles and generally, when concentration of toner particles is low, developing speed lowers and deposition amount of toner particles (image density) decreases and when concentration of toner particles is high, developing speed increases and deposition amount of toner particles (image density) increases.

However, as mentioned in detail below, in such liquid developing step, image reproducibility of so-called line image and that of solid image are contrary to each other and there is the problem that it is difficult to obtain well-balanced images.

First, in the case of line image, low potential portions (nearly 0 in potential) of thin width are formed in the form of lines in the high potential area formed by initial charging and high potential portions are arranged on both sides of the low potential portions of thin width in such a manner that the former are placed between the latter. Thus, line of electric force of high density is formed in the whole of the linear low potential portions due to the high potential portions arranged on both sides of the linear low potential portions. This line of electric force of high density very strongly forms an electric field, which is considerably greater than the inherent developing electric field formed by developing bias. Therefore, deposition of toners in this developing step of line images occurs along the line of electric force of high density and thus, development by so-called edge effect is carried out. In general, owing to this edge effect, the line images are protuberantly formed at the surface.

Therefore, in order to obtain faithfully a highlight portion including the line images, it is preferred to reduce the solid concentration, namely, toner particle concentration in the liquid developer than usual and to lower the developing speed.

On the other hand, for formation of solid images, a low potential portion (nearly 0 in potential) of large area is formed in the high potential area formed by the initial charging. The high potential portion is present around the low potential portion of large area, but the edge effect by the high potential portion affects only the portion along the periphery and only the inherent developing field is formed in most of the low potential portion.

Accordingly, in the case of forming the solid image, developing action of the developing bias electric field is main and in order to obtain faithfully a dot shadow portion including the solid image, it is preferred to increase solid concentration, namely, toner particle concentration in the liquid developer than usual and to increase developing speed. However, if the toner particle concentration is too high, defect of gradation may occur in the dot shadow portion.

As explained above, developing condition for obtaining faithfully the highlight portion including line image (low toner concentration) and developing condition for obtaining faithfully the dot shadow portion including solid image (high toner concentration) are contrary to each other and when the highlight portion is to be faithfully obtained, black solid portion in the dot shadow portion cannot be satisfactorily reproduced and especially when black lines in the highlight portion are to be obtained, white portion in the dot shadow portion disappears. When the dot shadow portion is to be faithfully obtained, black lines in the highlight portion disappear.

In the case of the printing plate of the present invention, non-image portion other than the toner image portion formed by reversal development is decoated with an alkali solution and the exposed surface of a hydrophilized aluminum base is rendered water-receptive and the image portion is rendered ink-receptive. The interface between the toner image portion and the non-image portion has very important influences on properties of printing plate formed by the dissolution with alkali, for example, not only image sharpness, but also printing endurance. That is, unless the interface is sharply formed, the boundary formed by dissolution with alkali is not clear and sometimes whisker-like blot is generated from the interface when the printing plate is completed after decoating of the non-image portion or image edge becomes irregular and thus, good prints cannot be obtained.

Therefore, for the printing plate it is necessary to keep balance between the highlight portion and the shadow portion and it is necessary to obtain high image sharpness in reversal development.

SUMMARY OF THE INVENTION

The first object of the present invention is to provide a method for making an electrophotographic lithographic printing plate by reversal development by which toner images can be satisfactorily obtained without causing toner avalanching phenomenon.

The second object of the present invention is to provide a method for making an electrophotographic lithographic printing plate by reversal development by which both the line image and solid image which are contrary to each other in developing conditions can be obtained in well-balanced state.

The present invention for attaining the above first invention relates to a method for making an electrophotographic lithographic printing plate by reversal development which comprises uniformly charging the surface of an organic photoreceptor comprising an electrically conductive support and, provided thereon, an organic photoconductive compound bound with a resin binder, exposing the surface to a light image to form a static latent image corresponding to the light image on the surface of the organic photoreceptor and then, subjecting the static latent image to reversal development with an electrophotographic liquid developer containing charged toner particles, characterized in that the reversal development is carried out with the electrophotographic liquid developer at an electrodeposition potential within the range of 0–80 V in absolute value.

Since the electrodeposition potential of the electrophotographic liquid developer is limited to a given range, namely, 0–80 V in absolute value in the present invention, generation of toner avalanching phenomenon can be avoided and proper liquid reversal development can be performed and thus, good printing plates excellent in resolution can be obtained.

The present invention for attaining the second object relates to the above-mentioned method for making the electrophotographic lithographic printing plate, which is further characterized in that the reversal development is carried out with the electrophotographic liquid developer which contains charged toner particles which take part in the development in a total amount of 0.5% by weight or less, generally 0.05–0.5% by weight, preferably 0.1–0.5% by weight based on the solvent.

Since in the present invention the reversal development is carried out using an electrophotographic liquid developer having a toner concentration lower than usual concentration, developing speed is reduced than usual developing speed, whereby edge effect for line image is diminished. Accordingly, highlight portion including the line image can be satisfactorily reproduced. This high reproducibility of the highlight portion including line image can be obtained almost irrespective of magnitude of developing bias.

In this case, if developing bias is increased to strengthen the inherent developing electric field, even with using an electrophotographic liquid developer of low toner concentration, proper deposition amount of toner can be obtained for solid image and dot shadow portion including the solid image can also be faithfully obtained. Even if the developing bias is increased in this way, the reproducibility of highlight portion including line image is not damaged as explained above.

As explained above, according to the present invention, developing balance of highlight portion and shadow portion can be properly kept and besides, definite and sharp images can be obtained and interfacial boundary of images becomes sharp. Therefore, boundary in decoating with alkali becomes clear and there occur neither whisker-like blot at the interfacial boundary of image of the printing plate obtained by the decoating treatment nor irregularity at the edge of images. Thus, good prints can be obtained.

The reversal development is essential for the present invention and according to the normal development, proper deposition amount of toner for solid image cannot be obtained even when the developing bias is increased as mentioned above. This is because the developing bias in the normal development is applied in the direction of preventing the deposition of toner on the photoreceptor side.

DETAILED DESCRIPTION OF THE INVENTION

Figure 1:
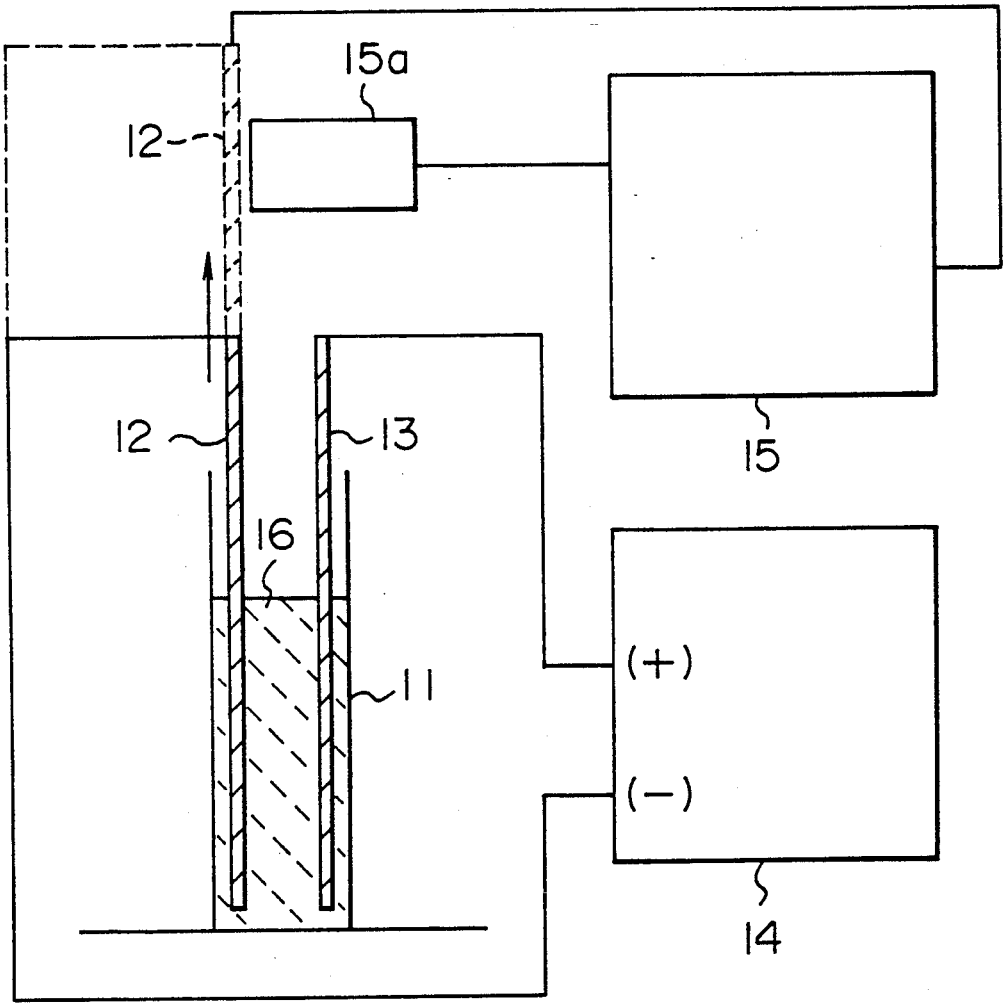
FIG. 1 is a schematic view of an apparatus for measurement of electrodeposition potential used in the present invention, in which 11 indicates a glass cell, 12 indicates an electrode (+ electrode), 13 indicates an electrode (− electrode), 14 indicates a device for supplying high voltage, 15 indicates a surface electrometer, 15*a* indicates a probe of the surface electrometer, and 16 indicates a liquid developer.

The present invention will be explained in more detail.

The electrophotographic liquid developers used in the present invention include those which are prepared by dispersing pigments such as carbon black and dispersion resins in highly insulating hydrocarbon media and those which are prepared by dispersing resin particles colored with dyes in place of the pigments and charged with charge control agents in highly insulating hydrocarbon media. The present invention can be applied to both of them, but the liquid developers of resin particle dispersion type are superior in dispersion stability, charge stability and fixability and are more effective for attaining the objects of the present invention.

As the liquid developers of resin particle dispersion type suitably usable in the present invention, there may be used resin dispersions which are obtained by polymerizing, in the presence of a polymer soluble in a highly insulating hydrocarbon medium, a monomer which is soluble in the medium, but insoluble upon being polymerized, by so-called dispersion polymerization process as described in Japanese Patent Kokai Nos. 59-83174, 59-177572, 59-212850, 59-212851, 60-164757, 60-179751, 60-185962 and 60-185963. Moreover, there may be suitably used liquid developers described in Japanese Patent Kokai Nos. 62-231266, 62-231267, 62-232660, 63-178258 and 63-179368. These liquid developers are superior in stability in industrial production and dispersion stability.

The highly insulating hydrocarbon media used in the present invention are highly electrically insulating organic solvents having low dielectric constants and include, for example, n-paraffinic hydrocarbons, isoparaffinic hydrocarbons, alicyclic hydrocarbons, aromatic hydrocarbons and halogeno aliphatic hydrocarbons and preferred are isoparaffinic hydrocarbons such as, for example, Shell Sol 71 (Shell Chemical Co.), Isopar G, Isopar H, Isopar K and Isopar L (Esso Petroleum Co.) and IP Solvent (Idemitsu Petrochemical Co.).

As the coloring agents for the dispersion resin particles of the liquid developers used in the present invention, there may be optionally used those which are generally known as coloring agents for wet developers. Examples thereof are oil-soluble dyes such as Oil Black and Oil Red, basic azo dyes such as Bismarck Brown and chrysoidine, acid azo dyes such as Wool Black, Amido Black Green and Blue Black HF, direct dyes such as Direct Deep Black E and Congo Red, anthraquinone dyes such as Sudan Violet and Acid Blue, carbonium dyes such as Auramine, Malachite Green, Chrystal Violet and Victoria Blue, rhodamine dyes such as Rhodan B and quinoneimine dyes such as Safranine, Nigrosine and Methylene Blue.

Coloration of the dispersion resin particles can be carried out, for example, by previously dissolving a coloring agent in a solvent and adding dropwise this coloring agent solution to a dispersion resin particle solution with stirring. Especially preferable coloration can be performed by dissolving an oil dye in an aromatic solvent such as toluene or xylene and adding dropwise this solution with stirring. In this case, the solvent which dissolves the coloring agent is desirably mixed with, for example, isoparaffinic hydrocarbon solvent used as the medium referred to hereabove. Further, the solvents which dissolve the dyes preferably have relatively high insulating properties and high boiling points. As one example, in the case of using an oil-soluble dye, when an aromatic hydrocarbon such as xylene is used in a small amount, the resulting solution can be used as an electrophotographic liquid developer without removing the solvent. Accordingly, in the case of using a dye relatively high in solubility in organic solvents such as oil-soluble dyes, if amount of the solvent which dissolves the dye is decreased, there is no necessity to remove the solvent after coloration of the dispersion resin particles.

For the liquid developers used in the present invention, toners having positive charge or negative charge can be prepared by selecting charge control agents, dyes and others. As the charge control agents for the liquid developers used in the present invention, there may be used, for example, copper oleate, cobalt naphthenate, zinc naphthenate, aluminum stearate, manganese naphthenate, cobalt octylate, lecithin, sodium dioctylsulfonsuccinate, aluminum salts of Stabelite rosin, and charge control agents mentioned in Japanese Patent Kokoku Nos. 49-26594 and 49-26595 and Japanese Patent Kokai Nos. 60-173558, 60-175060, 60-179750, 60-182447, 60-218662, 61-278867, 62-30260, 62-34170 and 63-124056.

For preparation of negatively charged toners, monomers soluble in the above-mentioned media and having salt group (for example, copolymer of lauryl methacrylate and dimethylamino methacrylate) and acids insoluble in the media such as pyromellitic acid, trimellitic acid, trimesic acid and benzoic acid can be used in combination, but these are not limitative.

An apparatus for measurement of electrodeposition potential in the present invention is constituted of, for example, a glass cell having a main electrode and an opposing electrode, a device for supplying high voltage and a device for measurement of surface potential. For measurement, liquid developer is put in the glass cell provided with electrodes and the device for supplying high voltage is connected with the electrodes. After application of voltage for a given period, the main electrode on which toner is deposited is taken out and potential of the surface of the electrode is measured by a surface electrometer. In this case, distance between the electrodes, applied voltage and application time can be optionally set, but preferably they are set at such conditions as close to those of actual development. The measurement of the electrodeposition potential according to the present invention is possible for any liquid developers containing toner particles having a charge of either positive or negative polarity by adapting the polarity of the main electrode to that of the toner particles.

The standard method for evaluation of electrodeposition potential in the present invention is specified below.

Two flat electrodes are introduced into the liquid developer and an electric field of 30000 V/m is applied between the electrodes for 10 seconds. Immediately thereafter the electrodes are gently taken out and potential generated from the toners electrodeposited on the electrodes is measured by a surface electrometer.

Solid concentration of liquid developers, namely, total weight (based on the weight of solvent) of charged toner particles which take part in the development is measured by the following method.

First, a given amount of liquid developer is taken in a beaker and a pair of electrodes of fresh aluminum plates are dipped in the liquid developer and a direct voltage of 1000 V is applied. The charged toner particles in the liquid developer are electrodeposited on the electrode applied with opposite polarity and as a result, toner concentration in the liquid developer in the beaker gradually decreases. The toner particles are almost completely recovered upon repetition of this procedure three times and the liquid developer becomes a red transparent liquid.

Then, the aluminum electrode on which toner particles are electrodeposited is dried. After the solvent has been completely evaporated, change in weight of the aluminum electrode is measured. Weight of solid matter of the liquid developer is obtained by the resulting measured value and based on this measured value, solid concentration of the liquid developer is calculated.

Toner average particle size of the liquid developer used in the present invention is suitably 0.03–0.5 μm, more preferably 0.05–0.3 μm.

The electrophotographic lithographic printing plates used in the present invention comprise an electrically conductive support and, provided thereon, at least one photoconductive layer.

As the electrically conductive support, there may be used plastic sheets and paper having conductive surface and metallic sheets such as aluminum sheet and zinc sheet and so on. The support has a thickness of preferably 0.1–3 mm, especially preferably 0.1–0.5 mm. Among these supports, suitable are anodized aluminum sheets having a roughened surface. The sheets used in the present invention are not limited in their composition and surface treatments applied thereto and materials known for printing plates can be optionally used.

On such electrically conductive support is provided an electrophotographic photosensitive layer known per se. As photoconductive materials used in the photosensitive layer, there may be used various known inorganic or organic compounds. Examples of the inorganic photoconductive materials are selenium and selenium alloys, amorphous silicon, Cd, CdSe, CdSSe, ZnO, and ZnS. As the organic photoconductive materials, known organic photoconductive compounds such as phthalocyanine and derivatives thereof and the like can be used. If necessary, these organic photoconductive compounds may be used in combination of two or more.

Furthermore, various pigments and dyes may also be used for improvement of sensitivity of photoconductors or for making photoconductors having sensitivity in the desired wavelength region.

In the photoreceptors for electrophotographic printing plates, photoconductive compound per se can have film-formability, but when photoconductive compounds alone have no film-formability, binder resins can be used. In an electrophotographic photoconductive layer, it is necessary to finally remove the photoconductive layer of non-image portion and this step is determined by relative relation between solubility of the photoconductive layer in the decoating solution and resist property of toner images against the decoating solution and cannot be generally expressed, but polymer compounds soluble or dispersible in the decoating solution as shown below are at least preferred as binder resins. Copolymers containing monomers having acid anhydride group or carboxyl group and phenolic resins are high in charge maintenance when used in photoreceptor and so can be advantageously used.

Copolymer of styrene and maleic anhydride is preferred as the copolymers containing monomers having acid anhydride group. Copolymers of styrene and maleic monoester and bi- or higher copolymers of acrylic acid or metacrylic acid and alkyl esters, aryl esters or aralkyl esters thereof are preferred as copolymers containing monomers having carboxyl group. Novolak resins obtained by condensation of phenol, o-cresol, m-cresol or p-cresol with methanal or ethanal under acidic conditions are especially preferred as phenolic resins. The binder resins may be used alone or in combination of two or more.

The electrophotographic lithographic printing plate used in the present invention is obtained by coating a photoconductive layer on an electrically conductive support by conventional methods. The photoconductive layer can be formed by containing the components in one layer or by containing them in two or more separate layers, for example, by using a carrier generation material and a carrier transport material separately in different layers. Either method can be employed. The coating solution is prepared by dissolving respective components constituting the photoconductive layer in suitable solvents. When components insoluble in solvents such as pigments are used, these are dispersed to average particle size of 0.01–5 μm by dispersing machines such as ball mill, paint shaker and Dyno mill. Binder resins and other additives used in the photoconductive layer can be added at or after dispersion of pigments and the like. The thus prepared coating solution is coated on a support by known methods such as spin coating, blade coating, dip coating, rod bar coating, and spray coating and is dried to obtain an electrophotographic lithographic printing plate.

If necessary, the photoconductive layer may further contain plasticizers, surface active agents and other additives for improving film properties of the photoconductive layer such as flexibility and surface state of coat in addition to the photoconductive compound and the binder resin.

An intermediate layer may optionally be provided between the electrically conductive support and the photoconductive layer for improvement of adhesion and electrophotographic characteristics.

The thus obtained electrophotographic lithographic printing plate is cut to a desired size and can be used as a printing plate after subjected to the following plate making treatments. In order to inhibit ink staining on side portions of the printing plate caused when a printing paper is larger in size than the printing plate, a layer which maintains potential of charging step may be provided on the side portions of the cut electrophotographic lithographic printing plate. Furthermore, in order to accelerate decoating of that layer, an intermediate layer higher in hydrophilicity than the potential maintaining layer may be provided under the potential maintaining layer.

The present invention will be explained in detail by the following examples, but the present invention should not be limited to the process of synthesis of toner particles and examples of liquid developers used therein and the point of the present invention is to make printing plates with liquid developers having an electrodeposition potential within the range of 0–80 V. Parts used in the examples are by weight.

Example 1

(Synthesis of emulsion)

A 40% xylene solution of n-hexyl methacrylate-methacrylic acid copolymer (weight ratio 95/5) was prepared by a known solution polymerization process.

30 g of this solution was added to 1 liter of hexane to obtain a precipitate of the copolymer as a slurry.

The slurry was subjected to washing and decantation with hexane several times and was charged in a 1 liter four-necked flask provided with an $N_2$ gas introduction pipe, a thermometer, a stirrer and a condenser, followed by adding thereto 450 g of IP Solvent (Idemitsu Petrochemical Co.).

Then, 130 g of vinyl acetate and 30 g of lauryl methacrylate were added thereto, followed by well stirring to obtain a homogeneous transparent solution. After the atmosphere inside the flask was replaced with $N_2$ gas, 1 g of azobisisobutyronitrile (AIBN) was added to start the polymerization. After about 40 minutes, the solution began to become cloudy and internal temperature rose to 110° C. After the internal temperature decreased to 80° C., heating was further conducted for 2 hours. In order to remove remaining vinyl acetate monomer, distillation was carried out under reduced pressure to obtain about 3 g of a distillate. The resulting white emulsion contained no precipitate and had substantially no monomer smell. Particle size was measured by an electron microscope to obtain 0.20 μm with substantially no particle size distribution.

(Preparation of positively charged liquid developer)

To 70 g of the emulsion obtained in the above synthesis example was added dropwise a solution of Oil Black HBB (2 g) (Orient Chemical Co.) in xylene (20 g) under application of ultrasonic, thereby to color the emulsion particles.

Then, to the emulsion was added a 1% xylene solution of Al salt of Stabelite rosin in an amount of 0.3 g, 0.6 g, 1.2 g, 3 g or 6 g as a charge control agent to obtain five kinds of concentrated toners.

Each of these concentrated toners was diluted to totally 10 liters with Isopar G to obtain a positively charged liquid developer. Concentration of toner particles after diluted was 0.23% by weight.

(Measurement of electrodeposition potential)

Electrode 12 and opposite electrode 13 were arranged at an interval of 2 mm in glass cell 11 shown in FIG. 1 and 7 cc of the liquid developer was gently poured therein. A voltage of 600 V was applied between electrodes 12 and 13 for 10 seconds from high voltage supplying device 14 (TR300C of Advantest Co.) to electrodeposit the toner particles on electrode 12. Immediately thereafter, electrode 12 (− electrode) was gently pulled up and surface potential of about central portion of the deposited toners was measured by surface electrometer 15 (Model 362A of Trek Co.).

Electrodeposition potentials in the above-obtained positively charged liquid developers A, B, C, D, and E are shown in Table 1.

TABLE 1

| Liquid developer | Electrodeposition potential [V] | |
|---|---|---|
| A | 14 | The present invention |
| B | 49 | The present invention |
| C | 75 | The present invention |
| D | 150 | Not the present invention |
| E | 179 | Not the present invention |

(Preparation of electrophotographic lithographic printing plate)

A JIS 1050 aluminum sheet was dipped in a 10% aqueous NaOH solution at 60° C. to carry out etching of the sheet so that dissolution amount of aluminum reached 6 g/m$^2$. After washed with water, the aluminum sheet was dipped in a 30% aqueous nitric acid solution for 1 minute and neutralized and then, was sufficiently washed with water. Thereafter, the surface of the sheet was electrolytically roughened in a 0.7% aqueous nitric acid solution for 20 seconds and then the sheet was dipped in a 20% aqueous sulfuric acid solution at 50° C. to clean the surface and then washed with water. Furthermore, this sheet was subjected to anodization treatment in a 20% aqueous sulfuric acid solution, washing with water and drying to obtain a support for printing plate.

On this support was coated by a bar coater the following composition for photoconductive layer dispersed for 1 hour by a paint shaker and was dried at 90° C. for 5 minutes to obtain an electrophotographic lithographic printing plate. In this case, coating amount of the photoconductive layer was 4.5 g/m$^2$.

| The composition for photoconductive layer: | |
|---|---|
| Butyl methacrylate/methacrylic acid copolymer (methacrylic acid 40%) | 18 parts |
| Metal-free phthalocyanine | 4 parts |
| Butyl acetate | 60 parts |
| 2-Propanol | 18 parts |

(Reversal Development)

The thus obtained electrophotographic lithographic printing plate was charged by corona discharging in the dark to obtain a surface potential ($V_0$) of about +300 V and thereafter was subjected to scanning imagewise exposure by a semiconductor laser (780 nm) and immediately subjected to reversal development with liquid developer A, B, C, D, or E. The developing bias voltage in this reversal development was set at 0 to +300 V.

After the toner development, the plate was cooled by cold air and then, was subjected to heat fixing by an infrared lamp to form a toner image on the photoconductive layer.

Results of the toner development with liquid developers A, B, C, D, and E are as follows.

When A–C were used, clear good images were obtained and high reproducibility was obtained for both dots and lines.

When liquid developers D and E were used, defect of gradation occurred in shadow portion of the dot area, resulting in only unsatisfactory images. Especially, when non-image portion was continuous, toner particles charged in the same polarity as that of the non-image portion were repelled by the non-image portion and as a result, migrated to electrode side and electrodeposited on the surface of the electrode and accumulated thereon or localized to cause clogging. Since individual toner in such electrodeposited and accumulated state or localized state had a large charge quantity, electric field generated from these toner particles was added to the inherent developing electric field and by the action of this additional electric field, a large amount of toner particles abruptly began to migrate to the photoreceptor side at a certain timing. Thus, there occurred the toner avalanching phenomenon, namely, a large amount of toner particles were deposited on both the non-image portion and the image portion. (Plate making treatment)

Next, plate making treatments were carried out using the following, decoating, washing and rinsing solutions.

| | |
|---|---|
| (1) Composition of decoating solution: | |
| Aqueous sodium silicate solution ($SiO_2$ content: 30% by weight; $SiO_2/Na_2O$ molar ratio: 2.5) | 20 parts |
| Potassium hydroxide | 1 part |
| Pure water | 79 parts |
| (2) Composition of washing solution: | |
| Sodium dioctylsulfosuccinate | 0.1 part |
| Pure water | 99.9 parts |
| (3) Composition of rinsing solution: | |
| Citric acid | 0.8 part |
| Phosphoric acid (85% aqueous solution) | 0.5 part |
| Decaglyceryl monolaurate | 0.05 part |
| Pure water | 100 parts |

When plate making was carried out using the above solutions, no problems occurred such as insufficient decoating of non-image portion. Printing was carried out by the customary method using the resultant five kinds of printing plates. Prints having good and clear images of high quality were obtained by the printing plates obtained according to the present invention. On the other hand, good prints were not obtained by the printing plates which were not of the present invention. Especially, when printing plates in which the toner avalanching phenomenon occurred were used, defect of gradation in the shadow portion of dots occurred and only unsatisfactory copies could be obtained.

Example 2

(Preparation of negatively charged liquid developer)

Five kinds of concentrated toners were prepared in the same manner as in Example 1 except that trimellitic acid and a 50% solution of a copolymer comprising dimethylamino methacrylate (20 wt. %) and lauryl methacrylate (80 wt. %) in IP Solvent were added at the ratio shown in Table 2 as charge control agents for negative charging. Each of these concentrated toners was diluted to totally 10 liters with Isopar G to obtain negatively charged liquid developer. Concentration of toner particles after diluted was 0.23% by weight. Electrodeposition potential in these negatively charged liquid developers F, G, H, I and J was as shown in Table 3.

TABLE 2

| | Amount of trimellitic acid | Amount of the copolymer |
|---|---|---|
| F | 1 mg | 2 g |
| G | 2 mg | 4 g |
| H | 4 mg | 8 g |
| I | 8 mg | 12 g |
| J | 16 mg | 12 g |

TABLE 3

| Liquid developer | Electrodeposition potential [V] | |
|---|---|---|
| F | −38 | The present invention |
| G | −69 | The present invention |
| H | −79 | The present invention |
| I | −126 | Not the present invention |
| J | −200 | Not the present invention |

Measurement of the electrodeposition potential was conducted in the same manner as above except that polarities of the electrodes in the cell were reversed.

(Preparation of electrophotographic lithographic printing plate)

A JIS 1050 aluminum sheet was dipped in a 10% aqueous NaOH solution at 60° C. to carry out etching of the sheet so that dissolution amount of aluminum reached 6 g/m$^2$. After washed with water the aluminum sheet was dipped in a 30% aqueous nitric acid solution for 1 minute and neutralized and then, was sufficiently washed with water. Thereafter, the surface of the sheet was electrolytically roughened in a 0.7% aqueous nitric acid solution for 20 seconds and then the sheet was dipped in a 20% aqueous sulfuric acid solution at 50° C. to clean the surface and then washed with water. Furthermore, this sheet was subjected to anodization treatment in a 20% aqueous sulfuric acid solution, washing with water and drying to obtain a support for printing plate.

On this support was coated by a bar coater the following composition for photoconductive layer dispersed for 1 hour by a paint shaker and was dried at 90° C. for 5 minutes to obtain an electrophotographic lithographic printing plate. In this case, coating amount of the photoconductive layer was 4.5 g/m$^2$.

The composition for photoconductive layer:

| | |
|---|---|
| Butyl methacrylate/methacrylic acid copolymer (methacrylic acid 40%) | 18 parts |
| 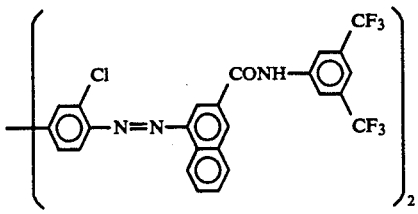 | 4.5 parts |
| 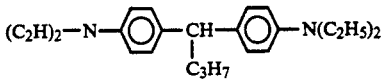 | 1 part |
| 1,4-Dioxane | 60 parts |
| 2-Propanol | 18 parts |

(Reversal development)

The thus obtained electrophotographic lithographic printing plate was charged by corona discharging in the dark to obtain a surface potential ($V_0$) of about −350 V and thereafter was subjected to scanning imagewise exposure by He-Ne laser (633 nm) and immediately subjected to reversal development with liquid developer F, G, H, I and J. The developing bias voltage in this reversal development was set at 0 to −300 V.

After the toner development, the plate was cooled by cold air and then, was subjected to heat fixing to form a toner image on the photoconductive layer.

Results of the toner development with liquid developers F, G, H, I, and J are as follows.

When F–H were used, good and clear images were obtained and high reproducibility was obtained for both dot portion and line portion.

When liquid developers I and J were used, defect of gradation occurred in shadow portion of the dot area, resulting in only unsatisfactory images. Especially, when non-image portion was continuous, toner particles charged in the same polarity as that of the non-image portion were repelled by the non-image portion and as a result, migrated to electrode side and electrodeposited on the surface of the electrode and accumulated thereon or localized to cause clogging. Since individual toner in such electrodeposited and accumulated state or localized state had a large charge quantity, electric field generated from these toner particles added to the inherent developing electric field and by the action of this additional electric field, a large amount of toner particles abruptly began to migrate to the photoreceptor side at a certain timing. Thus, there occurred the toner avalanching phenomenon, namely, a large amount of toner particles were deposited on both the non-image portion and the image portion.

(Plate making treatment)

Next, plate making treatments were carried out using the following decoating, washing and rinsing solutions.

| | |
|---|---|
| (1) Composition of decoating solution: | |
| Aqueous sodium silicate solution ($SiO_2$ content: 30% by weight; $SiO_2/Na_2O$ molar ratio: 2.5) | 20 parts |
| Potassium hydroxide | 1 part |
| Pure water | 79 parts |
| (2) Composition of washing solution: | |
| Sodium dioctylsulfosuccinate | 0.1 part |
| Pure water | 99.9 parts |
| (3) Composition of rinsing solution: | |
| Citric acid | 0.8 part |
| Phosphoric acid (85% aqueous solution) | 0.5 part |
| Decaglyceryl monolaurate | 0.05 part |
| Pure water | 100 parts |

When plate making was carried out using the above solutions, no problems occurred such as insufficient decoating of non-image portion. Printing was carried out using the resultant five kind of printing plates. Prints having good and clear images of high quality were obtained by the printing plates obtained according to the present invention. On the other hand, good prints were not obtained by the printing plates which were not of the present invention. Especially, when printing plates in which the toner avalanching phenomenon occurred were used, defect of gradation in the shadow portion of dots occurred and only unsatisfactory copies could be obtained.

Example 3

To 44 g of the emulsion obtained in Example 1 were added 1 g of Sumikalon Navy blue and 5 g of butanol and the mixture was shaken in a paint conditioner together with glass beads. The whole of the resulting blue dispersion and diisobutylene-octadecyl maleate half amide copolymer in the amount as shown in Table 4 were dispersed in IP Solvent to make up totally 8 liters to obtain liquid developers I–V. Toner particle concentration after diluted was 0.17% by weight. Electrodeposition potential of these liquid developers was measured in the same manner as in Example 1 and the results are also shown in Table 4.

TABLE 4

| Liquid developer | Amount of copolymer | Electrodeposition potential | |
|---|---|---|---|
| I | 0.5 mg | 15 V | The present invention |
| II | 2 mg | 25 V | The present invention |
| III | 4 mg | 60 V | The present invention |
| IV | 10 mg | 125 V | Not the present invention |
| V | 20 mg | 160 V | Not the present invention |

Plate making steps such as reversal development, fixation, and decoating were conducted with these liquid developers in accordance with the procedure of Example 1. The printing plates obtained by using liquid developers I–III had good images and good prints were obtained. However, when liquid developers IV and V were used, toner avalanching phenomenon occurred during the reversal development and reproducibility of dot shadow portion was much inferior to that of the printing plates made using liquid developers I–III and good prints could not be obtained.

Example 4

20 g of styrene-butyl methacrylate-N,N-dibutylethyl methacrylate copolymer, 5 g of carbon black #30 (Mitsubishi Chemical Industries, Ltd.) and 75 g of xylene were mixed and dispersed for 3 hours by an attritor using iron balls.

The whole of the resulting black dispersion and cobalt naphthenate in the amount as shown in Table 5 were dispersed in IP Solvent to make up totally 8 liters to obtain liquid developers VI–X. Toner particle concentration after diluted was 0.35% by weight. Electrodeposition potential of these liquid developers was measured in the same manner as in Example 1 and the results are also shown in Table 5.

TABLE 5

| Liquid developer | Amount of N* | Electrodeposition potential | |
|---|---|---|---|
| VI | 0.3 mg | 15 V | The present invention |
| VII | 1 mg | 20 V | The present invention |
| VIII | 3 mg | 55 V | The present invention |
| IX | 10 mg | 115 V | Not the present invention |
| X | 20 mg | 150 V | Not the present invention |

N* means cobalt naphthenate.

Plate making steps such as reversal development, fixation, and decoating were conducted with these liquid developers in accordance with the procedure of Example 1 to obtain printing plates. The printing plates obtained by using liquid developers VI–VIII were all high in resolution and in image quality and good prints were obtained.

However, when liquid developers IX and X were used, toner avalanching phenomenon occurred and defect of gradation occurred in the shadow of dot portion and good printing plates could not be obtained. The printed images were also inferior in resolution and low in quality with no gradation in dot portion.

Example 5

(Preparation of positively charged liquid developer)

To 120 g of the emulsion obtained in the same synthesis example of Example 1 was added dropwise a solution of Oil Black HBB (2 g) (Orient Chemical Co.) in xylene (20 g) under application of ultrasonic, thereby to color the emulsion particles.

Then, to the emulsion was added 1 g of a 1% solution of 4-aminopyridine in xylene as a charge control agent to obtain a concentrated toner.

This concentrated toner was diluted with Isopar G to obtain eight kinds of positively charged liquid developers different in solid concentration. Solid concentration and electrodeposition potential of these positively charged liquid developers a–h are shown in Table 6. The solid concentration in this case is weight ratio of charged toner particles which take part in developing to the solvent.

TABLE 6

| Liquid developer | Solid concentration (wt %) | Electrodeposition potential (V) | |
|---|---|---|---|
| a | 0.12 | 17 V | The present invention |
| b | 0.23 | 36 V | The present invention |
| c | 0.35 | 58 V | The present invention |
| d | 0.42 | 75 V | The present invention |
| e | 0.62 | 97 V | Not the present invention |
| f | 0.86 | 132 V | Not the present invention |
| g | 1.0 | 151 V | Not the present invention |
| h | 2.2 | 196 V | Not the present invention |

(Preparation of electrophotographic lithographic printing plate)

The following composition for photoconductive layer dispersed for 1 hour by a paint shaker was coated on a treated surface of an aluminum support anodized to a centerline average roughness (Ra) of 0.55 μm and was dried at 90° C. for 5 minutes to obtain an electrophotographic lithographic printing plate. In this case, coating amount of the photoconductive layer was 4.5 g/m$^2$.

| | |
|---|---|
| Butyl methacrylate/methacrylic acid copolymer (methacrylic acid 40%) | 18 parts |
| X-type metal-free phthalocyanine | 4 parts |
| 1,4-Dioxane | 60 parts |
| 2-Propanol | 18 parts |

(Toner reversal development)

The thus obtained electrophotographic lithographic printing plate was charged by corona discharging in the dark to obtain a surface potential ($V_0$) of about +300 V and thereafter was subjected to scanning imagewise exposure by a semiconductor laser (780 nm) at a density of 2000 DPI to form various static latent images of from highlight image portion having an area ratio of dots of 7% to shadow image portion having an area ratio of dots of 90%.

Immediately thereafter, the images were subjected to reversal development with liquid developer a, b, c, d, e, f, g, or h. The developing bias voltage set in this reversal development was varied within the range of from 0 to +300 V for each liquid developer. Distance between electrodes was set at 1–5 mm. If the distance is shorter than this range, the printing plate contacts with electrodes and if it is longer than the range, the air enters thereinto and this is not preferred.

After the toner development, the plate was cooled by cold air and then, was subjected to heat fixing by an infrared lamp to form a toner image on the photoconductive layer.

Results of the toner development with liquid developers a–h were as follows.

When liquid developer a was used, development could be satisfactorily performed, but toner concentration of the developer was too low and development became impossible before development of the desired number of plates. In this case, if replenishment of the toner is properly continued, satisfactory development can be attained as in the case of using liquid developers b, c, and d mentioned below.

When liquid developers b, c and d were used, good and clear images were obtained and high reproducibility was obtained for both the highlight portion including line images and dot shadow portion including solid images. The results will be studied below.

First, it is considered that reproduction of the highlight portion including line image was satisfactorily attained because the toner concentration of the liquid developer in this case was set at lower level than that of normally used liquid developers (solid concentration: about 1%). That is, employment of the low toner concentration caused reduction of developing speed and diminishment of edge effect on line images. Therefore, protruberation of black line portion as in usual development occurred little and deposition of the toner on the non-image portion was also little and as a result, both the black line portion and the non-image portion were satisfactorily reproduced. This high reproducibility of the highlight portion was obtained irrespective of intensity of developing bias, namely, intensity of inherent developing electric field.

On the other hand, for the dot shadow portion including solid images, high reproducibility was obtained when the inherent developing electric field was increased by setting the developing bias at relatively high level. That is, deposition of toner on the solid image is carried out mainly by the developing bias and the edge effect which occurs independently of the developing bias affects only the peripheral portion of the solid image. Therefore, even when liquid developers of low toner concentration is used as in the present invention, amount of the toner which deposits on the solid image can be properly maintained as long as the inherent developing electric field is set at high level by enhancing the developing bias. Furthermore, even if the developing bias is enhanced in this way, reproducibility of the highlight portion including line images is not damaged.

When liquid developer e was used, image reproducibility to some extent was obtained, but clarity of the non-image portion especially in the dot shadow portion decreased as compared with the case when liquid developers b, c and d were used.

When liquid developers f, g and h were used, the highlight portion including line images was formed protuberantly due to the edge effect and besides, there occurred defect of gradation in the dot shadow portion including solid images and faithful image reproducibility was not obtained. It is considered that this is because toner concentration of the liquid developer was too high and developing speed was increased more than required and as a result, valance in development of the line image portion and the shadow portion was lost.

(Plate making treatment)

Next, plate making treatments were carried out using the following decoating, washing and rinsing solutions.

| | |
|---|---|
| Aqueous sodium silicate solution ($SiO_2$ content: 30% by weight; $SiO_2/Na_2O$ molar ratio: 2.5) | 20 parts |
| Potassium hydroxide | 1 part |
| Pure water | 79 parts |

(2) Composition of washing solution (20 dm$^3$):

0.1 part of sodium dioctylsulfosuccinate and 0.01 part of 2-methyl-3-isothiazolone were dispersed and dissolved in pure water to obtain 100 parts of a solution.

This solution was charged in a washing tank. After making 100 plates, 15 ml of 5 wt. % aqueous glycine solution was added thereto after treatment of every 10 printing plates (A2 size).

Composition of rinsing solution (20 $dm^3$):

| | |
|---|---|
| Succinic acid | 0.5 part |
| Phosphoric acid (85% aqueous solution) | 0.5 part |
| Decaglyceryl monolaurate | 0.05 part |
| 2-Methyl-3-isothiazolone | 0.01 part |

To the mixture of the above components was added sodium hydroxide to adjust pH of the mixture to 4.7, followed by adding pure water to obtain 100 parts by weight of a solution.

When plate making was carried out using the above solutions (setting the time for decoating of non-image portions at 8 seconds), no problems occurred such as delay in decoating of non-image portions (remaining of pigments). In this way, printing plates were obtained.

Printing was carried out using the resultant eight printing plates. Prints having good and clear images of high quality were obtained by the printing plates obtained according to the present invention. On the other hand, good prints were not obtained by the printing plates which were not of the present invention. Especially, when printing plates in which defect of gradation occurred in the shadow portion of dots were used, only unsatisfactory copies could be obtained.

Example 6

(Preparation of negatively charged liquid developer)

Concentrated toners were prepared in the same manner as in Example 5 except that 0.08 g of sodium dioctylsulfosuccinate was used as a charge control agent for negative charging.

Each of these concentrated toners was diluted to totally 10 liters with Isopar G to obtain eight negatively charged liquid developers different in solid concentration. Solid concentration of each of these negatively charged liquid developers j, k, l, m, n, p, q and r were as shown in the following Table 7. The solid concentration in this case is a weight ratio of the charged toner particles taking part in development to the solvent.

TABLE 7

| Liquid developer | Solid concentration (wt %) | Electrodeposition potential (V) | |
|---|---|---|---|
| j | 0.15 | 15 | The present invention |
| k | 0.24 | 29 | The present invention |
| l | 0.32 | 51 | The present invention |
| m | 0.46 | 73 | The present invention |
| n | 0.65 | 96 | Not the present invention |
| p | 0.92 | 130 | Not the present invention |
| q | 1.4 | 167 | Not the present invention |
| r | 2.2 | 187 | Not the present invention |

(Preparation of electrophotographic lithographic printing plate)

On a treated surface of an aluminum support anodized to a center line average roughness (Ra) of 0.55 μm was coated the same composition for photoconductive layer as used in Example 2 by a bar coater and was dried at 90° C. for 5 minutes to obtain an electrophotographic lithographic printing plate. In this case, coating amount of the photoconductive layer was 4.5 $g/m^2$.

(Toner reversal development)

The thus obtained electrophotographic lithographic printing plate was charged by corona discharging in the dark to obtain a surface potential ($V_0$) of about −350 V and thereafter was subjected to scanning imagewise exposure by an He-Ne laser (630 nm) at a density of 2000 DPI to form images of from highlight image portion having an area ratio of dots of 7% to shadow image portion having an area ratio of dots of 90%.

Immediately thereafter, the images were subjected to reversal development with liquid developer j, k, l, m, n, p, q, and r. The developing bias voltage set in this reversal development was varied within the range of from 0 to −300 V for each liquid developer. Distance between electrodes was set at 1–5 mm.

After the toner development, the plate was cooled by cold air and then, was subjected to heat fixing by an infrared lamp to form a toner image on the photoconductive layer.

Results of the toner development with the eight liquid developers j, k, l, m, n, p, q, and r were as follows.

When liquid developer j was used, development per se could be satisfactorily performed, but toner concentration of the developer was too low and development became impossible before development of the desired number of plates. In this case, if replenishment of the toner is properly continued, satisfactory development can be attained as in the case of using liquid developers k, l and m mentioned below.

When liquid developers k, l, and m were used, good and clear images were obtained and high reproducibility was obtained for both the highlight portion including line images and dot shadow portion including solid images. This high reproducibility of the highlight portion was obtained irrespectively of intensity of the developing bias, namely, intensity of the inherent developing electric field.

On the other hand, for the dot shadow portion including solid images, high reproducibility was obtained when the inherent developing electric field was increased by setting the developing bias at relatively high level. Furthermore, even if the developing bias was enhanced in this way, reproducibility of the highlight portion including line images was not damaged as mentioned above.

When liquid developer n was used, image reproducibility to some extent was obtained, but clarity of the non-image portion especially in the dot shadow portion decreased as compared with the case when liquid developers k, l and m were used.

When liquid developers p, q and r were used, the highlight portion including line images was formed protruberantly due to the edge effect and besides, there occurred loss of gradation in the dot shadow portion including solid images and faithful image reproducibility was not obtained.

(Plate making treatment)

Next, plate making treatments were carried out using the following decoating, washing and rinsing solutions.

(1) Composition of decoating solution:

| | |
|---|---|
| Aqueous sodium silicate solution | 20 parts |

-continued

| | |
|---|---|
| ($SiO_2$ content: 30% by weight; $SiO_2/Na_2O$ molar ratio: 2.5) | |
| Potassium hydroxide | 1 parts |
| Pure water | 79 parts |

(2) Composition of washing solution:

0.1 part of sodium dioctylsulfosuccinate and 0.01 part of 2-methyl-3isothiazolone were dispersed and dissolved in pure water to obtain 100 parts by weight of a solution. This solution was charged in a washing tank. After making 100 plates, 15 ml of 5 wt. % aqueous glycine solution was added thereto after treatment of every 10 printing plates (A2 size).

(3) Composition of rising solution (20 $dm^3$):

| | |
|---|---|
| Succinic acid | 0.5 part |
| Phosphoric acid (85% aqueous solution) | 0.5 part |
| Decaglyceryl monolaurate | 0.05 part |
| 2-Methyl-3-isothiazolone | 0.01 part |

To the mixture of the above component was added sodium hydroxide to adjust pH of the mixture to 4.7, followed by adding pure water to obtain 100 parts by weight of a solution.

When plate making was carried out using the above solutions (setting the time for decoating of non-image portions at 8 seconds), no problems occurred such as delay in decoating of non-image portions (remaining of pigments). In this way, printing plates were obtained.

Printing was carried out using the resultant eight printing plates. Prints having good and clear images of high quality were obtained by the printing plates obtained according to the present invention. On the other hand, good prints were not obtained by the printing plates which were not of the present invention. Especially, when printing plates in which defect of gradation occurred in the shadow portion of dots were used, only unsatisfactory copies could be obtained.

Example 7

(Synthesis Example 2 of emulsion)

150 g of 20% solution of stearyl methacrylate-methacrylic acid copolymer (weight ratio 97/3) in Isopar G, 95 g of vinyl acetate, 5 g of N-vinylpyrrolidone and 1.0 g of AIBN were charged in a 1 liter four-necked flask and total amount was adjusted to 650 g with Isopar G. The atmosphere inside the flask was replaced with $N_2$ gas, followed by heating to 80° C. to start polymerization. Internal temperature rose to 105° C. and a stable cloudy emulsion was produced. After the internal temperature lowered to 80° C., heating was further carried out for 2 hours. The resulting emulsion had no precipitate and emulsion average particle size was 0.18 μm.

(Preparation of positively charged liquid developer)

Five positively charged liquid developers different in solid concentration were prepared using the above emulsion particles in the same manner as in Example 1. Solid concentration of each of these positively charge liquid developers $X_1$, $X_2$, $X_3$, $X_4$ and $X_5$ were as shown in the following Table 8. The solid concentration in this case is a weight ratio of the charged toner particles taking part in development to the solvent.

TABLE 8

| Liquid developer | Solid concentration (wt %) | Electrodeposition potential (V) | |
|---|---|---|---|
| $X_1$ | 0.18 | 27 | The present invention |
| $X_2$ | 0.25 | 42 | The present invention |
| $X_3$ | 0.45 | 67 | The present invention |
| $X_4$ | 0.57 | 92 | Not the present invention |
| $X_5$ | 0.92 | 143 | Not the present invention |

Results of the toner development with the five liquid developers $X_1$, $X_2$, $X_3$, $X_4$ and $X_5$ were as follows.

When liquid developer $X_1$ was used, development per se could be satisfactorily performed, but toner concentration of the developer was too low and development became impossible before development of the desired number of plates. In this case, if replenishment of the toner is properly continued, satisfactory development can be attained as in the case of using liquid developers $X_2$ and $X_3$ mentioned below. It When liquid developers $X_2$ and $X_3$ were used, good and clear images were obtained and high reproducibility was obtained for both the highlight portion including line images and dot shadow portion including solid images. This high reproducibility of the highlight portion was obtained irrespective of intensity of the developing bias, namely, intensity of the inherent developing electric field.

On the other hand, for the dot shadow portion including solid images, high reproducibility was obtained when the inherent developing electric field was increased by setting the developing bias at relatively high level. Furthermore, even if the developing bias was enhanced in this way, reproducibility of the highlight portion including line images was not damaged as mentioned above.

When liquid developer $X_4$ was used, image reproducibility to some extent was obtained, but clarity of the non-image portion especially in the dot shadow portion decreased as compared with the case when the above liquid developers $X_2$ and $X_3$ were used.

When liquid developer $X_5$ was used, the highlight portion including line images was formed protuberantly due to the edge effect and besides, there occurred defect of gradation in the dot shadow portion including solid images and faithful image reproducibility was not obtained.

Example 8

(Synthesis Example 3 of emulsion)

60 g of dodecyl methacrylate, 100 g of vinyl acetate, and 1.6 g of AIBN were charged in a 1 liter four-necked flask and total amount was adjusted to 650 g with Isopar G. The atmosphere inside the flask was replaced with $N_2$ gas, followed by heating to an internal temperature of 80° C. and after about 1 hour, the internal temperature rose to 105° C. and a stable cloudy emulsion was produced. After the internal temperature lowered to 80° C., heating was further carried out for 2 hours. The resulting emulsion had no precipitate and emulsion average particle size was 0.10 μm.

(Preparation of positively charged liquid developer)

Five positively charged liquid developers different in solid concentration were prepared using the above emulsion particles in the same manner as in Example 7. Solid concentration of each of these positively charged liquid developers $Y_1$, $Y_2$, $Y_3$, $Y_4$ and $Y_5$ were as shown in the following Table 9. The solid concentration in this case is a weight ratio of the charged toner particles taking part in development to the solvent.

TABLE 9

| Liquid developer | Solid concentration (wt %) | Electrodeposition potential (V) | |
|---|---|---|---|
| $Y_1$ | 0.21 | 42 | The present invention |
| $Y_2$ | 0.32 | 55 | The present invention |
| $Y_3$ | 0.46 | 70 | The present invention |
| $Y_4$ | 0.65 | 106 | Not the present invention |
| $Y_5$ | 1.2 | 162 | Not the present invention |

Results of the toner development with the five liquid developers $Y_1$, $Y_2$, $Y_3$, $Y_4$ and $Y_5$ were as follows.

When liquid developers $Y_1$, $Y_2$, and $Y_3$ were used, good and clear images were obtained and high reproducibility was obtained for both the highlight portion including line images and dot shadow portion including solid images. This high reproducibility of the highlight portion was obtained irrespective of intensity of the developing bias, namely, intensity of the inherent developing electric field.

On the other hand, for the dot shadow portion including solid images, high reproducibility was obtained when the inherent developing electric field was increased by setting the developing bias at relatively high level. Furthermore, even if the developing bias was enhanced in this way, reproducibility of the highlight portion including line images was not damaged as mentioned above.

When liquid developer $Y_4$ was used, image reproducibility to some extent was obtained, but clarity of the non-image portion especially in the dot shadow portion decreased as compared with the case when the above liquid developers $Y_1$, $Y_2$ and $Y_3$ were used.

When liquid developer $Y_5$ was used, the highlight portion including line images was formed protuberantly due to the edge effect and besides, there occurred defect of gradation in the dot shadow portion including solid images and faithful image reproducibility was not obtained.

According to the present invention, dot images of high line density can be developed with high resolution without causing the toner avalanching phenomenon in electrophotographic wet type reversal development for making electrophotographic lithographic printing plates.

Furthermore, high reproducibility can be obtained for both the highlight portion including line images and the dot shadow portion including solid images by setting the toner solid concentration of liquid developers at a lower value below a certain value and thus, toner images can be very satisfactorily formed on a photoreceptor for printing plate and prints of high quality can be obtained.

What is claimed is:

1. A method for making an electrophotographic lithographic printing plate by reversal development which comprises uniformly charging the surface of an organic photoreceptor comprising an electrically conductive support and, provided thereon, an organic photoconductive compound bound with a resin binder, exposing the surface to a light image to form a static latent image corresponding to the light image on the surface of the organic photoreceptor and then, subjecting the static latent image to reversal development with an electrophotographic liquid developer containing charged toner particles, wherein the reversal development is carried out with the electrophotographic liquid developer having an electrodeposition potential set within the range of 0–80 V in absolute value.

2. A method according to claim 1, wherein total weight of the toner particles is 0.5% or less based on the weight of a solvent of the liquid developer.

3. A method according to claim 1, wherein average particle size of toner particle is 0.03–0.5 μm.

4. A method according to claim 1, wherein the toner particles are resin particles.

5. A method according to claim 1, wherein the toner particles are resin particles and have an average particle size of 0.03–0.5 μm.

6. A method according to claim 1, wherein the toner particles are resin particles and total weight of the toner particles is 0.5% or less based on the solvent of the liquid developer.

7. A method according to claim 1, wherein the toner particles are resin particles and have an average particle size of 0.03–0.5 μm and total weight of the toner particles is 0.5% or less based on the solvent of the liquid developer.

* * * * *